United States Patent [19]

Vello

[11] 4,070,770

[45] Jan. 31, 1978

[54] INSOLE FOR ROCK CLIMBING SHOE

[75] Inventor: Francesco Vello, Venegazzu (Treviso), Italy

[73] Assignee: Red Wing Shoe Company, Inc., Red Wing, Minn.

[21] Appl. No.: 768,848

[22] Filed: Feb. 15, 1977

Related U.S. Application Data

[63] Continuation of Ser. No. 660,133, Feb. 23, 1976, abandoned.

[30] Foreign Application Priority Data

Sept. 19, 1975 Italy ..... 2432/75

[51] Int. Cl.[2] ..... A43B 13/38

[52] U.S. Cl. ..... 36/43

[58] Field of Search ..... 36/43, 44

[56] References Cited

U.S. PATENT DOCUMENTS

| | | | |
|---|---|---|---|
| 1,807,341 | 5/1931 | Messler | 36/44 X |
| 2,403,329 | 12/1947 | Adler et al. | 36/44 X |
| 2,581,864 | 1/1952 | Kaufmann | 36/44 X |
| 2,635,363 | 4/1953 | Dorgin | 36/43 |
| 3,426,455 | 2/1969 | Drago | 36/44 X |

FOREIGN PATENT DOCUMENTS

| | | | |
|---|---|---|---|
| 658,875 | 5/1965 | Belgium | 36/44 |
| 580,576 | 8/1959 | Canada | 36/44 |
| 1,918,537 | 7/1971 | Germany | 36/44 |

*Primary Examiner*—Alfred R. Guest

[57] ABSTRACT

An insole, for a rock climbing shoe, formed of a single piece of synthetic plastic material to follow the anatomical shape of the wearer's foot, including a first portion of constant thickness in the longitudinal direction from the heel for a predetermined distance, and a second portion extending in prolongation of the first portion and being of linearly decreasing thickness down to a minimum value at the toe of the insole, so that the insole displays a differential flexibility in the longitudinal direction, with a maximum of flexibility near the toe.

6 Claims, 1 Drawing Figure

INSOLE FOR ROCK CLIMBING SHOE

This is a continuation of application Ser. No. 660,133, filed Feb. 23, 1976 now abandoned.

Background of the Invention

1. Field of the Invention

The present invention refers to a rock climbing shoe, and more particularly to an insole incorporated into said shoe.

2. Description of the Prior Art

It is well known that, in order to improve the purchase and to facilitate the step of a climber during ascent in rocks, and especially during ascents of difficult, steep grades, it is necessary and customary to impart to the soles of the rock climbing shoes a flexibility relative to a forward portion that includes the toe, and a stiffness relative to a rear portion that includes the heel.

At the present time, in order to satisfy such a need, incorporated into the sole of a rock climbing shoe is a thin metal plate which generally extends longitudinally over a short distance inside the sole itself.

However, the use of a thin metal plate presents some disadvantages, either from a technical point of view or from an economic point of view. In fact, taking into account the repeated and also considerable flexion forces to which a sole is subjected during a climb, the different degree of deformability of the thin metal plate and of the material (leather, rubber, plastic and the like) that constitute the sole is such that, after a short time, it is possible to verify the existence of deformations in the sole, humps that cancel out the desired comfort characteristics, to the point that it becomes necessary to change the shoe. Moreover, in many cases, it has been verified that the thin plate was directly causing ruptures in the sole, creating dangerous conditions for the climber. In other cases, which are no less frequent, it was possible to ascertain that, following long periods of non-use, the thin metal plate had conferred an accentuated concaveness to the sole which rendered the shoe completely unusable. To overcome such disadvantages, steps have been taken to increase the thickness of the material constituting the sole, but such an increase is reflected in an increase in weight for the entire shoe up to the point that it is no longer acceptable for ascents of some given difficulty. Other disadvantages associated with the use of a thin metal plate inside of a sole consist in the tediousness and the difficulty of incorporating such a plate and of the ensuing difficulty of applying the sole that is thus equipped to the footwear.

The problem that is the basis of this invention is that of making available a rock climbing shoe that is equipped with an insole having structural and functional characteristics such as to overcome the disadvantages cited above and referring to known technology.

Summary of the Invention

In accordance with the invention, this problem is resolved in that said insole is formed of a single piece of synthetic plastic material and has at least one portion, including the toe and part of the sole of the foot, that has a linearly variable thickness in the longitudinal direction, with respect to the insole itself, so that said insole displays a differentiated flexibility in said longitudinal direction with a maximum of flexibility relative to said toe.

Description of the Drawing

Further characteristics and advantages of the invention will be better understood from the following description of a preferred form of embodiment of an insole for a rock climbing shoe that is in accordance with the invention, description given in the following with reference to the attached sketch wherein said insole is represented, in the single FIGURE, in longitudinal cross section.

Description of the Preferred Embodiment

Figure 1:
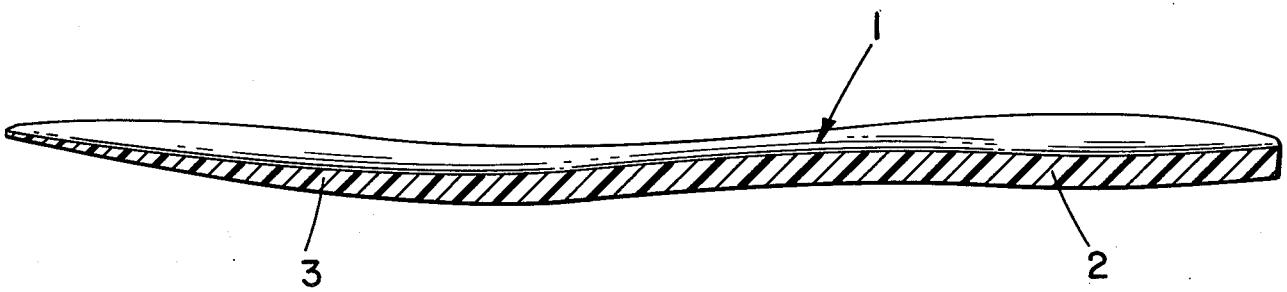

With reference to the above-mentioned FIGURE, represented overall by 1 is an insole for rock climbing shoes formed of a single piece by means of techniques that are known per se, using plastic materials, for example injection techniques (at pressures of 210–215 $Kg/cm^2$ and temperatures of 160°–190° C) using a mixture of polyamides, preferably a polyamide mixture known commercially under the name APLIFLEX 1026. Said insole 1 includes a first portion 2 that extends from the heel and up to a distance of about 10.5 cm from the toe end (the exact distance varies as a function of the shoe size, but is generally marked by that point where the ball of the foot rests on the insole), which portion 2 has a constant thickness in the longitudinal direction. Subsequent to numerous tests, it was possible to establish that the optimum thickness for this portion is 7mm for the material used. A second portion 3 that extends in prolongation of section 2 in order to include the toe of insole 1 has, in the longitudinal direction with respect to said sole, a thickness that decreases linearly up to attaining a minimum value relative to the toe. Following all of the numerous tests mentioned above, it was always possible to establish that the optimum thickness for said toe is 1mm for the material used.

A further dimensional characteristic of insole 1 of this invention is constituted by the fact that said insole has a constant thickness in each transverse section. Advantageously, insole 1 is given an anatomical shape, i.e., shaped to conform with the contour of the sole of the foot.

Additionally, such an insole is rapidly and easily applied to a sole for a rock climbing shoe, using for said application a "BLAK" stitching machine.

The nature of the material, method of molding, but above all the dimensional characteristics presented for insole 1 confer upon it a differentiated flexibility in the longitudinal direction, with a maximum of flexibility relative to the toe and a maximum of rigidity in portion 2 that includes the heel. Thanks to such characteristics, it has been possible to establish by repeated climbs of notable difficulty how a rock climbing shoe equipped with an insole of the type described above could provide noteworthy qualities of "purchase" at minimum lean-out (angle) to the rocky wall and how it facilitates the step of the climber with, consequently, less fatigue.

Added to these qualities, not to be found in rock climbing shoes incorporating insoles of earlier technology, are the advantages of resistance, wear and non-deformability over time, whether subsequent to intensive use or whether subsequent to extensive non-use.

I conclude, sticking to the concept of imparting to an insole of plastic material a differentiated flexibility in the longitudinal direction by means of a thickness gradient in the longitudinal direction of the insole itself, the values reported further above being capable of varying as a function of the dimensions of the insole and as a function of the intrinsic characteristics of the synthetic plastic material used.

What is claimed is:

1. In combination with a shoe used for rock climbing applications in which differentiated flexibility of a sole thereof in a longitudinal direction with a maximum of rigidity in a heel portion thereof and a maximum of flexibility in a toe portion thereof is desired to facilitate purchase of said sole with minimum lean-out, such differentiated flexibility traditionally being accomplished by a metal plate incorporated into said heel portion, the improvement which comprises:

an insole formed of a unitary piece of synthetic plastic material replacing said metal plate, said insole having a heel portion and a front portion, with said heel portion being of sufficient thickness to be substantially rigid in use, and said front portion underlying the toes and a portion of the ball of a wearer's foot in use, said front portion having a thickness substantially linearly variable and decreasing in the longitudinal direction toward the toes to provide substantially greater flexibility of the front portion than said heel portion while distributing stress throughout its length.

2. A rock climbing shoe in accordance with claim 1 wherein said insole has a constant thickness in each of its transverse sections.

3. A rock climbing shoe in accordance with claim 2 wherein said insole is shaped to conform with the contour of the foot.

4. A rock climbing shoe in accordance with claim 1 wherein said insole includes a first portion extending from the heel for a predetermined distance and having a constant thickness in the longitudinal direction with respect to the insole itself, and a second portion extending in prolongation of said first portion and having, in the longitudinal direction, a linearly decreasing thickness down to a minimum value relative to the toes of said insole.

5. A rock climbing shoe in accordance with claim 4 wherein said synthetic plastic material is constituted by a mixture of polyamides.

6. A rock climbing shoe in accordance with claim 5 wherein said mixture of polyamides is of the type commercially known under the name APIFLEX 1026.

* * * * *

UNITED STATES PATENT AND TRADEMARK OFFICE

CERTIFICATE OF CORRECTION

PATENT NO. : 4,070,770

DATED : January 31, 1978

INVENTOR(S) : FRANCESCO VELLO

It is certified that error appears in the above-identified patent and that said Letters Patent are hereby corrected as shown below:

The title should be changed from "INSOLE FOR ROCK CLIMBING SHOE" to --ROCK CLIMBING SHOE--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*